US007591955B2

(12) United States Patent
Frechette et al.

(10) Patent No.: US 7,591,955 B2
(45) Date of Patent: Sep. 22, 2009

(54) METHOD FOR FORMING AN ETCHED SOFT EDGE METAL FOIL AND THE PRODUCT THEREOF

(75) Inventors: Raymond A. Frechette, North Providence, RI (US); David W. West, Pembroke, MA (US); Christopher Machado, Swansea, MA (US); Christopher M. Sullivan, Acushnet, MA (US)

(73) Assignee: Interplex NAS, Inc., College Point, NY (US)

( * ) Notice: Subject to any disclaimer, the term of this patent is extended or adjusted under 35 U.S.C. 154(b) by 412 days.

(21) Appl. No.: 11/457,369

(22) Filed: Jul. 13, 2006

(65) Prior Publication Data

US 2007/0157762 A1 Jul. 12, 2007

Related U.S. Application Data

(60) Provisional application No. 60/699,927, filed on Jul. 14, 2005.

(51) Int. Cl.
*C23F 1/00* (2006.01)
*B44C 1/22* (2006.01)

(52) U.S. Cl. ..... 216/11; 216/41; 216/49; 216/56; 216/83; 216/100; 216/108; 134/3; 427/327

(58) Field of Classification Search ..... 216/56
See application file for complete search history.

(56) References Cited

U.S. PATENT DOCUMENTS 3,179,543 A * 4/1965 Marcelis ..... 216/56
3,679,500 A * 7/1972 Kubo et al. ..... 216/56
3,813,310 A * 5/1974 Droege et al. ..... 216/36
4,105,493 A 8/1978 Chauvy et al.
4,552,832 A 11/1985 Blume et al.
5,017,460 A 5/1991 Schuurman et al.
5,185,933 A 2/1993 Messinger et al.
5,484,074 A * 1/1996 Deibler et al. ..... 216/12
5,653,891 A * 8/1997 Otsuki et al. ..... 216/11
5,750,956 A 5/1998 Barnes et al.
5,802,932 A 9/1998 Vankov et al.
5,858,255 A * 1/1999 Kohara et al. ..... 216/20
7,285,497 B2 * 10/2007 Yotsuya ..... 438/700
2004/0071884 A1 * 4/2004 Newton ..... 427/385.5
2005/0067378 A1 * 3/2005 Fuerhaupter et al. ..... 216/34

* cited by examiner

*Primary Examiner*—Anita K Alanko
(74) *Attorney, Agent, or Firm*—Darby & Darby

(57) ABSTRACT

A metal processing method includes etching to remove material from a thin metal part. A pattern of etch resistant material is used to prevent etching of the metal in desired locations. The etch resistant material is intentionally applied to unclean surfaces so that an adhesion between the etch resistant material and the metal will fail during the etching process. An edge is formed during etching at the boundaries of the pattern of the etch resistant material. These edges are rounded where the adhesion fails. A shaver foil is produced using the described metal processing method including a face side, a cutter side and a plurality of whisker holes. A face edge is formed where an etched profile of the whisker hole meets the face side and a cutter edge is formed where the etched profile of the whisker hole meets the cutter side. The face edge is rounded using the aforementioned process and the cutter edge is sharp using a conventional etch resistant material application method.

19 Claims, 8 Drawing Sheets

(PRIOR ART)

METHOD FOR FORMING AN ETCHED SOFT EDGE METAL FOIL AND THE PRODUCT THEREOF

This patent application claims the benefit of priority of U.S. Provisional Patent Application Ser. No. 60/699,927, filed Jul. 14, 2005, entitled "METHOD FOR FORMING AN ETCHED SOFT EDGE TECHNOLOGY AND THE PRODUCT THEREOF" the entire disclosure of which is incorporated herein by reference.

FIELD OF INVENTION

The invention relates generally to metal processing and more particularly, to the processing of thin metal foils or metal strips.

BACKGROUND OF THE INVENTION

Many industries require thin metal parts with precise dimensions. Such parts include optical components, encoder discs, switch contacts, spacers and gaskets, meshes, thin screens, flat springs, and foils. There are currently numerous methods known to produce thin metal parts. The most popular methods are electroforming, etching, punch and die stamping, and cutting, either by laser or water jet. Electroforming is a process by which a metal part is produced on a base form. The base form is negatively charged and placed in a solution containing a salt of the metal desired for the part. The metal is deposited onto the base form and the part is formed. In contrast, the other methods begin with a thin metal sheet and remove material until the desired part is produced. Etching uses an acid to remove the base metal by chemical or electrochemical corrosion. An etch-resistant protective coating is adhered to the object in areas where the metal should remain. During the etch, only the unprotected parts are removed by corrosion.

For precision applications electroforming, etching, and punch and die stamping have a clear advantage over cutting because heat or mechanical energy generated during the cutting process deforms the edges of the cut. Electroforming and etching have a further advantage over stamping because the stamping process cannot readily create grooves or notches of a depth approximating half of the material thickness in the metal part. Although electroforming and etching can both produce seemingly very similar parts, the parts have geometries at a microscopic level that are quite different.

One application where thin metal parts are used is electric foil-head shavers. As shown in FIG. 1, a foil-head shaver 1 has a cutting element 5 which oscillates under a shaver foil 10. The shaver foil 10 serves as a guard to protect the user's face. The shaver foil 10, as shown in FIG. 2, has a skin side 20, a cutter side 25 and a plurality of whisker holes 30 which allow the user's hair to pass through and be cut by the cutting element 5.

Conventionally, shaver foils are produced by electroforming of nickel or another metal. A cross-sectional view of a shaver foil made by electroforming is shown in FIG. 3*a*. The cross section shown passes through the center of the whisker hole and includes the thinnest part of the shaver foil between adjacent whisker holes. An advantage of the electroformed foil is that the edges 56 of the whisker holes 30 on the face side 20 of the shaver foil 10 are rounded, providing user comfort. On the other hand, the edges 51 of the whisker holes 30 on the cutter side 25 are blunt resulting in poor cuts. This results in a shaver which is comfortable to use but does not perform optimally.

An alternative method of producing shaver foils is by etching the whisker holes in a preexisting metal foil. FIG. 3*b* shows a cross section corresponding to 3*a* of a shaver foil made by etching The etching produces sharp edges 57 and 52 on both the face side 20 and the cutter side 25, respectively, of the shaver foil 10. The sharp edges 52 on the cutter side 25 improve the cutting ability of the shaver, but the sharp edges 57 on the face side 20 are uncomfortable for the user. The etching process also allows the metal foil to be produced from various wrought metal alloys including stainless steels which have more desirable properties than can be produced by the electroforming process.

SUMMARY OF THE INVENTION

The present invention is for a thin-metal processing method which removes material from a thin metal foil or a metal strip. The processing method involves etching to create removed areas in the metal foil or strip. Novel surface preparation steps allow edges surrounding the removed areas to be either sharp or rounded. The processing method further allows both the sharp and rounded edges to be made in a single etching pass.

The present invention also relates to an improved shaver foil for a foil-head shaver. The shaver foil provides both face comfort and superior cutting ability over current foils.

The shaver foil includes a skin side, a cutter side and a plurality of whisker holes. The whisker holes allow a user's hair to pass through the shaver foil and be cut by a cutting element while the shaver foil protects the user's skin. The whisker holes have edges on both the face side and the skin side of the shaver foil. The skin side edge is a rounded "soft-edge" which provides comfort for the user's face. The cutter side edge is sharp to improve cutting ability.

The aforementioned thin-metal processing method is used to produce the improved shaver foil and includes a plurality of steps. The plurality of steps include (i) application of photo-resist or any other substance known in the art that resists corrosion during etching to an unclean surface of a thin metal foil or metal strip where a soft edge is desired, wherein the photo-resist or other corrosion resistant substance will improperly adhere to the surface due to the presence of elements such as metal particles, oils, small organic materials and/or oxidation on the unclean surface and the adhesion will fail during an etching step, allowing a slight corrosion of the base material to occur at areas where adhesion has failed; (ii) application of photo-resist or any other substance known in the art that resists corrosion during etching to a clean surface of a base material where a sharp edge is desired, wherein the photo-resist or other corrosion resistant substance will optimally adhere to the surface and prevent corrosion of the base material under that substance; and (iii) etching of the base material to produce a foil with a number of openings, each opening having a sharp edge on one side and a soft edge on another side.

Another metal processing method of the present invention includes the steps of (i) preparing a metal surface to produce marginal adhesion between the metal surface and a layer of etch-resistant material; (ii) applying the etch resistant material to the metal surface; and (iii) etching the metal. During the etching step the adhesive bond is progressively degraded with cumulative residence time in the etching acid, causing the resist bond to fail and delaminate only at or near the end of the etching step. Only limited edge rounding takes place locally on the immediate surfaces adjacent to the perimeter of the etched part, rather than generally across the entire surface.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF THE PREFERRED EMBODIMENTS

Figure 1:
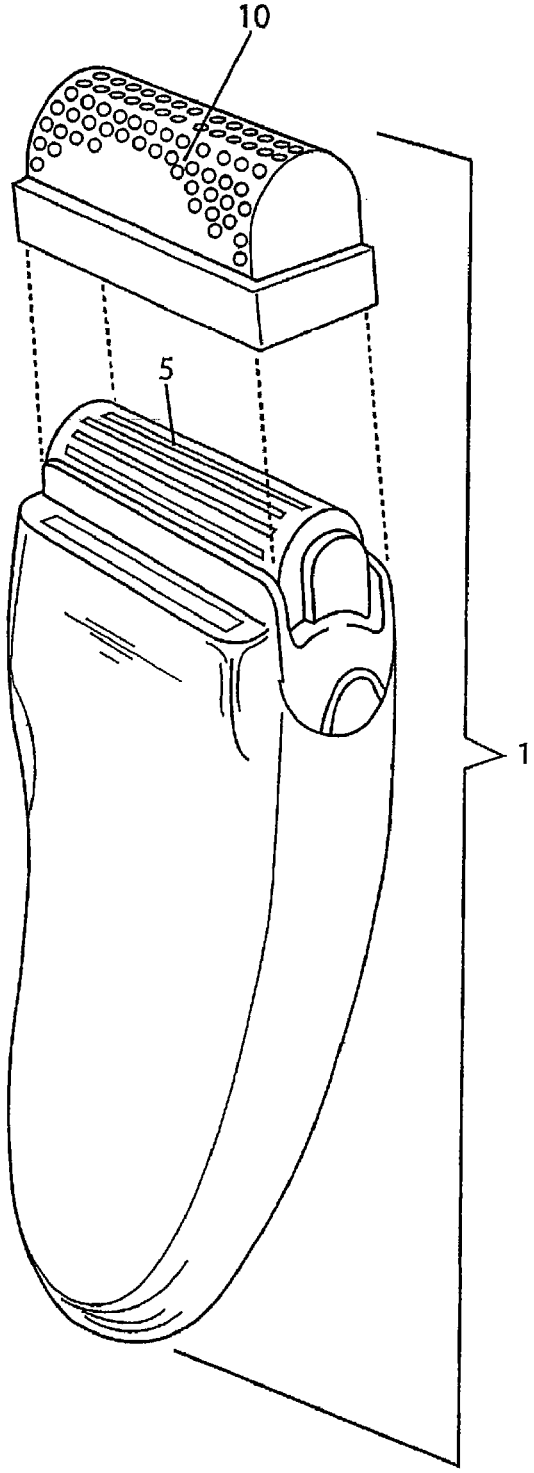
Fig. 1 (Prior Art)
FIG. 1 is a perspective view of a prior art foil-head shaver.
Figure 2:
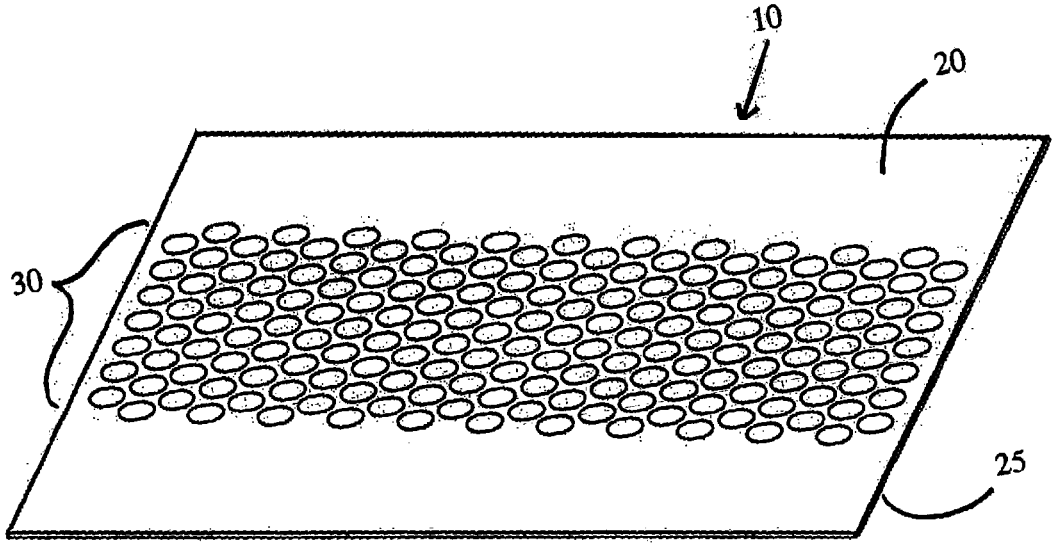
FIG. 2 is a perspective view of a prior art shaver foil.
Figure 3A:
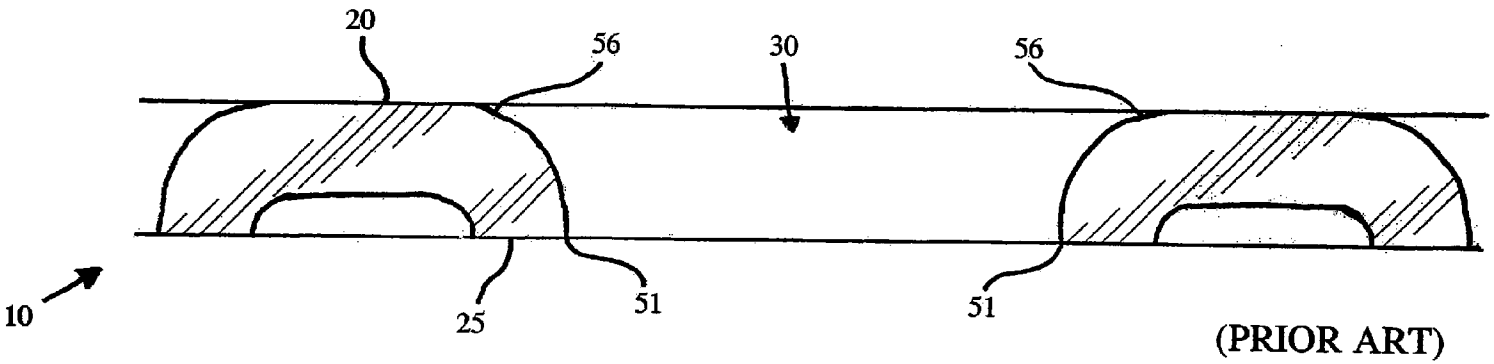
Fig. 3a (PRIOR ART)
FIG. 3*a* is an enlarged cross-sectional view of a single whisker hole within a prior art shaver foil produced by electroforming.
Figure 3B:
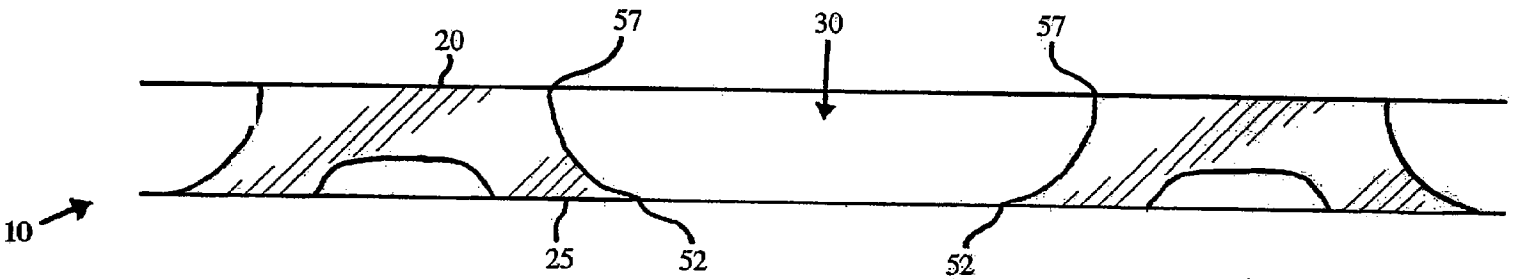
Fig. 3b (PRIOR ART)
FIG. 3*b* is an enlarged cross-sectional view of a single whisker hole within a prior art shaver foil produced by etching.
Figure 4:
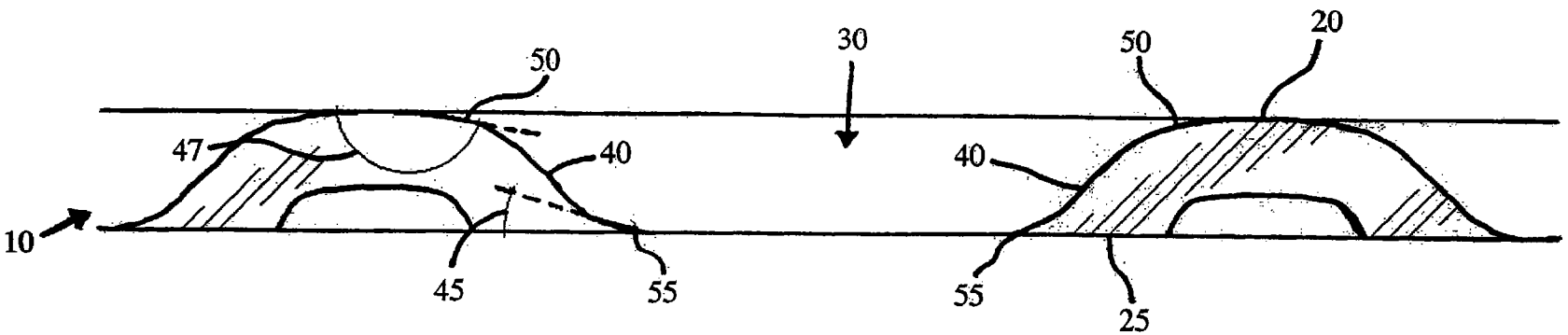
FIG. 4 is an enlarged cross-sectional view of a single whisker hole within a shaver foil produced in accordance with the present invention.

As shown in FIG. 1, a conventional foil-head shaver 1 includes a shaver foil 10 and a cutter element 5. The shaver foil 10 shown in detail in FIG. 2 includes a skin side 20, a cutter side 25 and a plurality of openings or holes 30. The openings, or whisker holes 30, allow a user's hair to pass through the shaver foil 10 and be cut by the cutter element 5. FIG. 4 shows a cross-section of one whisker hole 30 in accordance with an embodiment of the present invention, wherein the whisker hole is circular. The cross section shown in FIG. 4 passes through the center of the circular whisker hole 30 and shows the thinnest part of the shaver foil 10 between adjacent whisker holes 30. An edge profile 40 defines the perimeter of the whisker hole 30 and extends from the skin side 20 of the shaver foil 10 to the cutter side 25 of the shaver foil 10. A skin-side edge 50 is formed where the edge profile 40 meets the skin side 20, and a cutter-side edge 55 is formed where the edge profile 40 meets the cutter side 25. The edge profile 40 should be angled inward from the skin side 20 to the cutter side 25, such that the skin-side circumference of the hole 30 is larger than the cutter-side circumference of the hole 30. In other words, an angle 45 between the cutter side 25 of the shaver foil 10 and the edge profile 40 is acute. Thus, the cutter-side edge 55 is sharp. In contrast, an angle 47 between the skin side 20 and the edge profile 40 is obtuse. Additionally, the skin-side edge 50 is rounded.

The geometries of the skin-side edge 50 and the cutter-side edge 55 provide an improved shaver foil 10 in contrast to conventional shaver foils. The rounded skin-side edge is comfortable to the user's skin. There are no sharp edges which rub across the user's face. In addition, the sharp cutter-side edge 55 provides superior cutting ability over conventional shaver foils. When the sharp cutter-side edge 55 and the cutter element 5 come into close contact, any hairs positioned therebetween have a higher probability of being cut than if the cutter-side edge is blunt.

Figure 5:
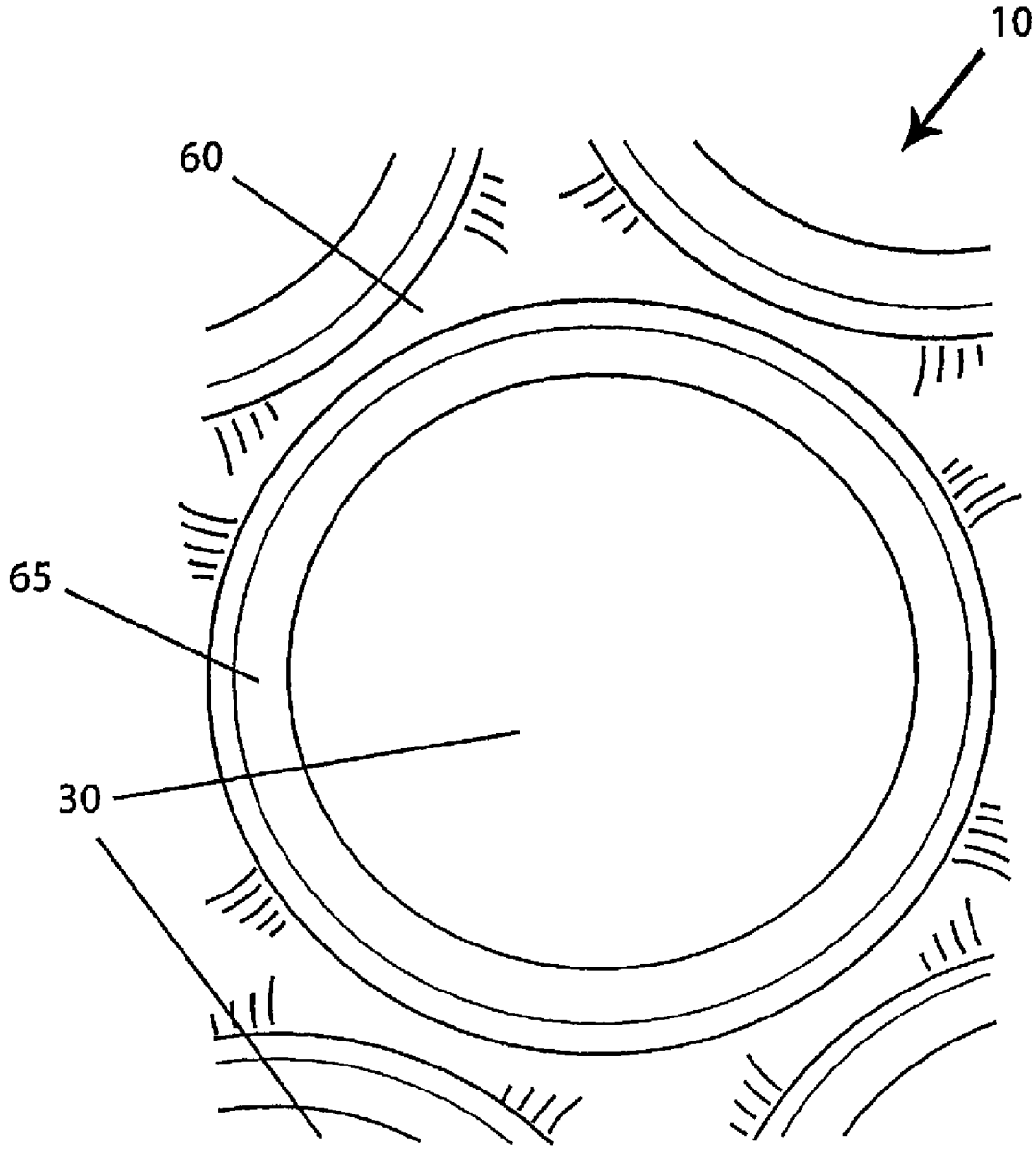
FIG. 5 is a bottom view of a shaver foil in accordance with the present invention.

In a preferred embodiment, as shown in FIG. 5, a relief 60 is formed over the majority of the cutter side 25 of the shaver foil 10. Only a margin 65 around the whisker holes 30 protrudes. The relief 60 helps reduce the amount of material which comes into close contact with the cutter. This reduces friction and the heat resulting thereof.

The present invention also relates to a method for producing the shaver foils. The preferred production method is described below in detail. However, the steps presented are not required to be carried out in a particular order, nor are the specific materials discussed the only materials which can be used to perform the method of the present invention.

Surface preparation is an important aspect of the method used in the present invention. Stock metal, as received from metal distributors, is never completely clean. Although the metal may not appear "dirty," the surface is likely to contain at least one contaminant. These contaminants may include organic materials, oils, small particles of metal resulting from the stock metal processing and slight oxidation of the surface. In order to produce an optimal adhesion between the etch-resistant coating and the metal surface, all contaminants must be removed. If the contaminants are not removed, the adhesion will fail during etching and the etch-resistant coating will not protect the metal surface.

The present invention uses controlled adhesion failure between the metal surface and the etch-resistant coating to create rounded edges at the boundaries of the etched part. In contrast, conventional etch preparation with optimal adhesion between the metal surface and the etch-resistant coating produces sharp edges around the etched perimeter. An embodiment of the preparation and etching method in accordance with the present invention is described in detail below.

A metal foil as received from a metal distributor is moderately cleaned. The cleaning process used should remove only a fraction of the contaminants on the metal surface. One embodiment of the moderate cleaning process in accordance with the present invention uses a microetch to remove a fraction of the contaminants. The microetch includes sulfuric and ferric chloride acids. In an alternative embodiment of the moderate cleaning process, an acid wash is used to moderately clean the metal foil. Regardless of the cleaning process used, some contaminants remain on the surface of the metal foil. Alternatively, the surface of the stock metal could be deliberately contaminated as a pre-treatment step to assure desired response to an optional cleaning process.

Figure 6A:
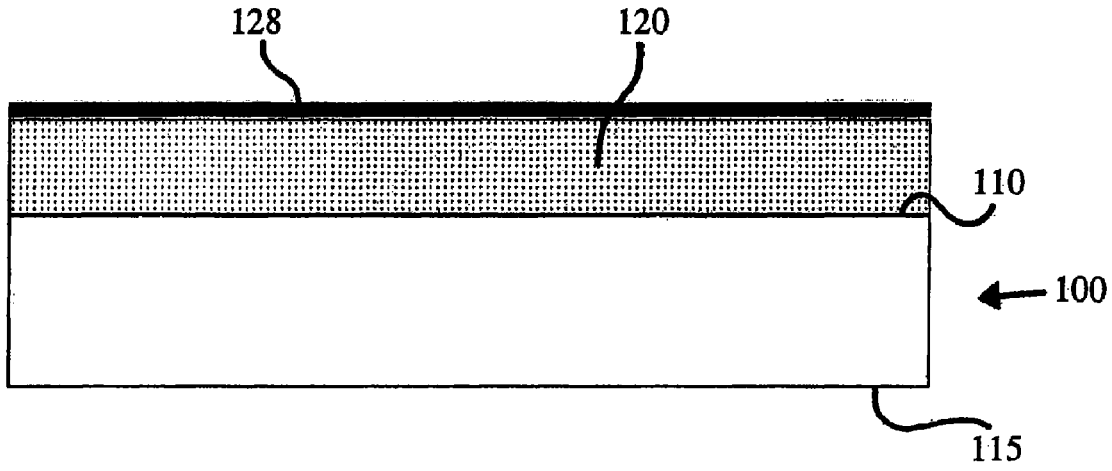
FIG. 6*a* is an enlarged cross-sectional view of a thin metal foil coated with etch resistant material and a protective coating on one side in accordance with the present invention.
Figure 6B:
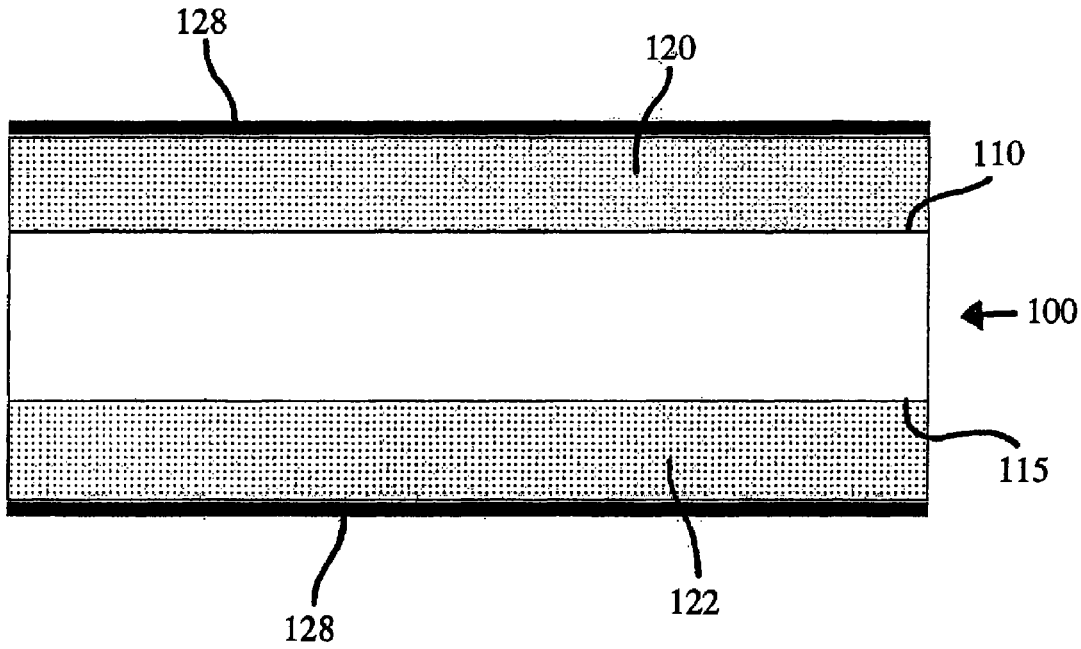
FIG. 6*b* is an enlarged cross-sectional view of a thin metal foil coated with etch resistant material and a protective coating on both sides in accordance with the present invention.

As shown in FIG. 6, the moderately clean metal foil 100 has a first side 110 and a second side 115 and is coated with a first layer of etch-resistant material (photo-resist) 120 on the first side 110. An imperfect adhesion between the first layer of photo-resist 120 and the first side 110 is made because of the remaining contaminants on the surface 110 of the metal foil 100. The first layer of photo-resist 120 is then covered with a protective coating 128; polyester film is used for the protective coating 128 in a preferred embodiment. The second side 115 is then properly cleaned. No harm is done to the first layer of photo-resist 120 during the cleaning because of the protective coating 128. As shown in FIG. 6*b*, a second layer of photo-resist 122 plus an additional protective coating 128 is then applied to the second side 115 of the metal foil. An optimal adhesion is formed between the second side 115 and the second layer of photo-resist 122. Due to the differences in adhesion, there are different bond strengths between the layers of photoresist and the metal foil.

Before etching the foil 100, sections of the photo-resist layers 120/122 are removed to create a pattern of photo-resist 124 on the metal surfaces 110/115. This will allow only some sections of the foil 100 to be removed during the etch. The sections of the metal foil 100 that are protected by the photo-resist pattern 124 will not be removed. The removed sections of photo-resist in the preferred embodiment include larger circles on the first side 110 and smaller circles on the second side 115. This will produce etched holes that angle inward from the first side 110 to the second side 115.

Figure 7A:
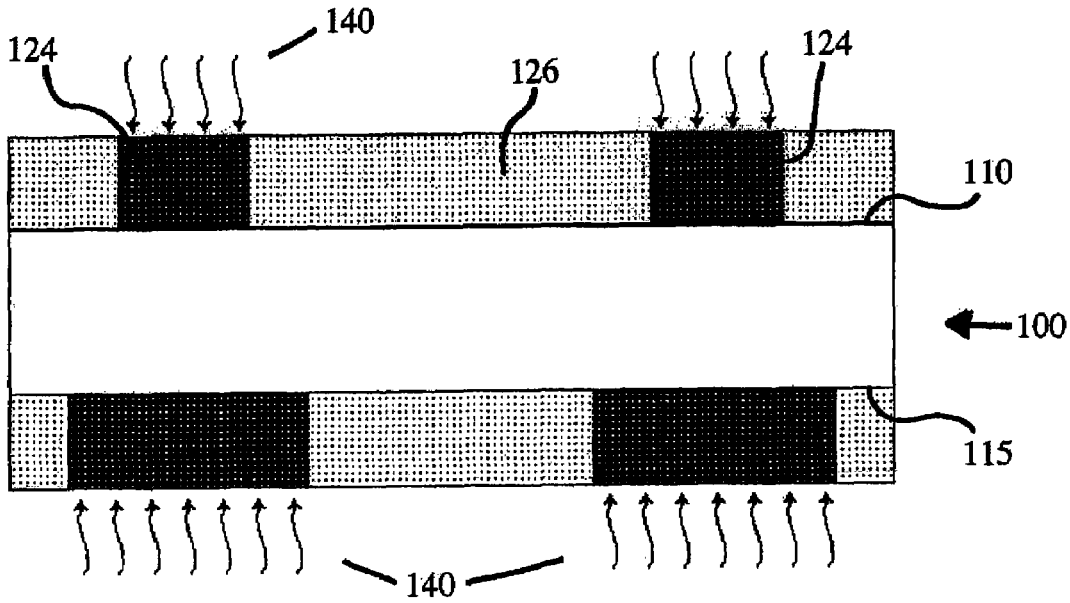
FIG. 7*a* is an enlarged cross-sectional view of a thin metal foil coated with partially exposed etch resistant material in accordance with the present invention.
Figure 7B:
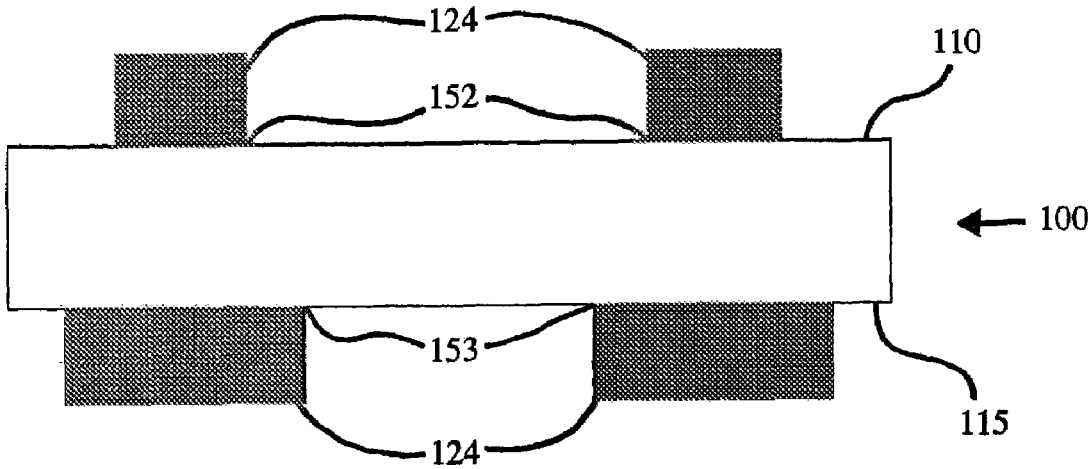
FIG. 7*b* is an enlarged cross-sectional view of a thin metal foil with an attached pattern of etch resistant material in accordance with the present invention.
Figure 8:
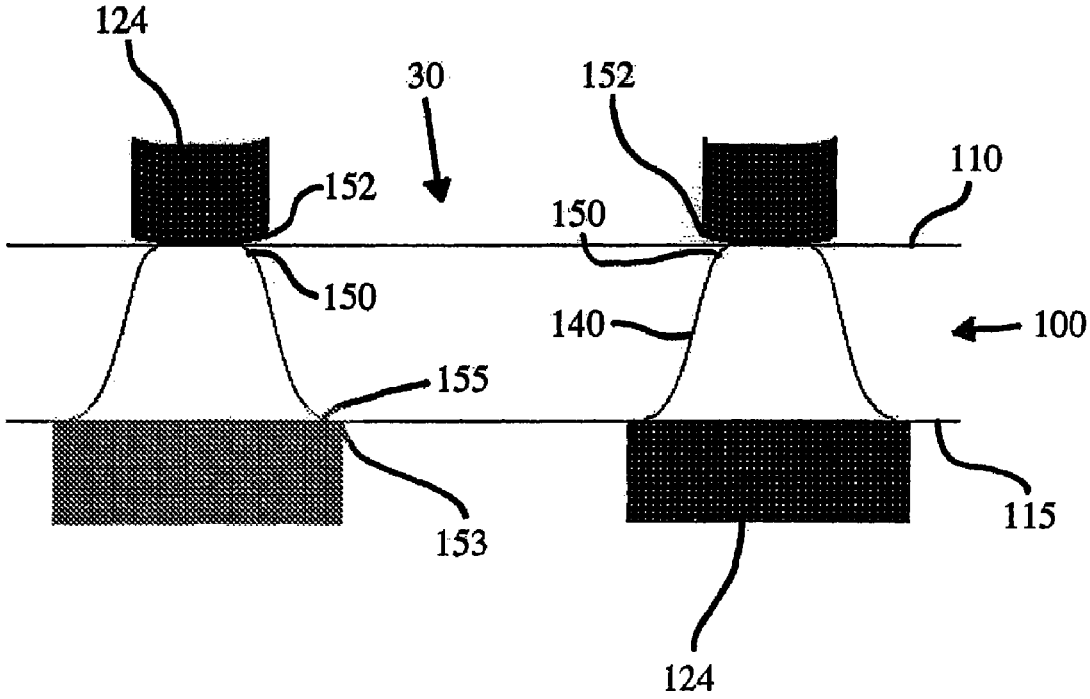
FIG. 8 is an enlarged cross-sectional view of a thin metal foil and an attached pattern of etch resistant material after it has been etched in accordance with the present invention.

Various methods may be used to create the pattern of photo-resist 124 on the foil 100. The methods depend on the type of photo-resist used. Either positive or negative photo-resist may be used. Positive photo-resist becomes more soluble when exposed to ultraviolet light. Any exposed sections of positive photo-resist are easily removed from the applied surface in a solution. The unexposed sections remain on the surface. In contrast, negative photo-resist polymerizes when exposed to ultraviolet light causing the polymer to become more stable and prevents dissolution in developer chemicals. The exposed sections of negative photo-resist remain on the surface while the unexposed sections of negative photo-resist are removed in a solution. In both methods, sections of the photo-resist layers 120/122 are exposed to ultraviolet light in order to create the photo-resist pattern 124. There are various methods that may be used to control which sections of photo-resist are exposed to the ultraviolet light. One method uses a filter at the source of the ultraviolet light, to project a pattern onto the photo-resist layers 120/122. An alternative method uses an opaque mask covering the photo-resist layers 120/122 to block some of the ultraviolet light. The preferred embodiment uses negative photo-resist and ultraviolet light that is filtered at the source. FIGS. 7*a*, 7*b* and 8 illustrate the preferred embodiment of the present invention.

As shown in FIG. 7*a*, both layers of photo-resist 120/122 are exposed to a pattern of ultraviolet rays 140. The ultraviolet rays 140 produce a pattern of exposed photo-resist 124 and a remainder of unexposed photo-resist 126. During the exposure, the photo-resist polymerizes. The unexposed photo-resist 126 is then removed from the foil 100 in a solution, and only the pattern of exposed photo-resist 124 remains. The metal foil 100 with the attached pattern of exposed photo-resist 124 is shown in FIG. 7*b*. The boundaries of the pattern of exposed photo-resist 124 define first edges 152 where the exposed photo-resist 124 and metal foil 100 meet on the first side 110 and second edges 153 where the exposed photo-resist 124 and metal foil 100 meet on the second side 115.

The metal foil 100 is then subjected to an etching acid and holes 30 are formed. In the preferred embodiment, high specific gravity ferric chloride etching acid is used. The resulting part is shown in FIG. 8. During the etch, areas of the metal foil 100 that were not protected by photo-resist are removed completely forming a plurality of holes 30 in the metal foil 100. The optimal adhesion between the pattern of photo-resist 124 on the second side 115 and the metal foil 100 keeps the photo-resist on the second side 115 intact during the etch. This produces a sharp edge 155 where the side 140 of the hole 30 meets the second side 115 of the metal foil 100. In contrast, the adhesion between the pattern of exposed photo-resist 124 on the first side 110 and the metal foil 100 fails during the etch. The failure begins at the first edges 152 of the photo-resist pattern 124 on the first side 110. As the adhesion fails the areas under which failure occurs come into contact with the etching acid. As a result, the etching acid corrodes the metal in those areas and creates rounded edges 150.

In an alternative embodiment (not shown) the adhesion between the photo-resist pattern 124 and the first side 110 of the metal foil 100 fails almost entirely during the etch. The adhesion does not fail upon immediate contact with the etching acid, rather, the photo-resist pattern is slowly peeled from the edges 152 until it is nearly entirely removed. As a result, the areas of the metal foil 100 under the edges 152 of the photo-resist pattern 124 erode more than the areas under the majority of the photo-resist pattern 124 and a gradual curve is formed from the edge of the hole 30 to the first side 110 of the metal foil 100.

After etching, the photo-resist polymer patterns are removed and the resulting part is the shaver foil. The first side 110 is the skin side 20, the second side 115 is the cutter side 25 and the holes 30 are the whisker holes 30 of the shaver foil 10.

In an alternative embodiment of the present invention the metal foil may be first properly cleaned to remove all contaminants from the metal surface and photo-resist may be applied to those areas where optimal adhesion is desired to produce sharp edges. An adhesion inhibiting material may then be applied to the metal foil to inhibit the adhesion of a second layer of photo-resist applied to the metal foil. This will result in a failure of the adhesion and rounded "soft" edges will result. Alternatively, the adhesion inhibiting material may be applied to the second layer of photo-resist before application and both layers of photo-resist may be applied simultaneously.

Although the preferred form of the invention has been shown and described, many features may be varied, as will readily be apparent to those skilled in this art. It is the intention, therefore, to be limited only as indicated by the scope of the claims appended hereto.

We claim:

1. A thin material processing method comprising the steps of:

preparing a first surface of a thin base material;

adhesively bonding a first etch resistant material to the first surface to form a first adhesive bond between the first etch resistant material and the first surface;

forming a first pattern in the first etch resistant material on the first surface, the first pattern defining at least one boundary of the first etch resistant material;

cleaning a second surface of the thin base material, the second surface being on a side opposite the first surface;

adhesively bonding a second etch resistant material to the second surface to form a second adhesive bond between the second etch resistant material and second surface;

forming a second pattern in the second etch resistant material on the second surface, the second pattern defining at least one boundary of the second etch resistant material on the second surface;

etching the thin base material to form:

a rounded edge in the thin base material at the at least one boundary of the first pattern of first etch resistant material by degrading the first adhesive bond of the thin base material and the first etch resistant material at the at least one boundary of the first pattern of first etch resistant material, and a sharp edge at the at least one boundary of the second pattern of second etch resistant material by preventing etching of the thin base material beyond the at least one boundary of the second pattern of second etch resistant material by maintaining the second adhesive bond, wherein the cleaning results in maintaining the second adhesive bond relative to the degrading of the first adhesive bond.

2. A thin material processing method comprising the steps of:

preparing a first surface of a thin base material;

adhesively bonding a first etch resistant material to the first surface to form an adhesive bond between the first etch resistant material and the first surface;

forming a first pattern in the first etch resistant material on the first surface, the first pattern defining at least one boundary of the first etch resistant material;

etching the thin base material to form a rounded edge in the thin base material at the at least one boundary of the first pattern of first etch resistant material by degrading the adhesive bond of the thin base material and the first etch resistant material at the at least one boundary of the first pattern of first etch resistant material, cleaning a second surface of the thin base material, the second surface being on a side opposite the first surface;

adhesively bonding a second etch resistant material to the second surface;

forming a second pattern in the second etch resistant material on the second surface, the second pattern defining at least one boundary of the second etch resistant material on the second surface; and forming a sharp edge at the at least one boundary of the second pattern of second etch resistant material, whereby the cleaning of the second surface results in substantial adherence between the second surface and the second pattern of second etch resistant material which prevents etching of the thin base material beyond the at least one boundary of the second pattern of second etch resistant material thereby resulting in the sharp edge.

3. The processing method of claim 2 wherein the step of preparing the first surface includes exposing the first surface to a microetch including sulfuric and ferric chloride acids.

4. The processing method of claim 2 wherein the step of preparing the first surface includes exposing the first surface to an acid wash.

5. The processing method of claim 2 wherein the etching step further comprising the step of etching using ferric chloride acid.

6. The processing method of claim 2 wherein the first etch resistant material is photo-resist.

7. The processing method of claim 6 wherein the step of forming a first pattern in the first etch resistant material includes exposing the first etch resistant material to ultraviolet light.

8. The processing method of claim 2 further comprising the step of covering the first etch resistant material on the first surface with a protective coating before the step of cleaning the second surface.

9. A metal foil processing method comprising the steps of:

preparing a first surface of a metal foil;

adhesively bonding a first etch resistant material to the first surface to form an adhesive bond between the first etch resistant material and the first surface;

forming a first pattern in the first etch resistant material on the first surface, the first pattern defining at least one boundary of the first etch resistant material;

etching the metal foil to form a rounded edge in the metal foil at the at least one boundary of the first pattern of first etch resistant material by degrading the adhesive bond of the metal foil and the first etch resistant material at the at least one boundary of the first pattern of first etch resistant material, cleaning a second surface of the metal foil, the second surface being on a side opposite the first surface;

adhesively bonding a second etch resistant material to the second surface;

forming a second pattern in the second etch resistant material on the second surface, the second pattern defining at least one boundary of the second etch resistant material on the second surface; and forming a sharp edge in the metal foil at the at least one boundary of the second pattern of second etch resistant material, whereby the cleaning of the second surface results in substantial adherence between the second surface and the second pattern of second etch resistant material which prevents etching of the metal foil beyond the at least one boundary of the second pattern of second etch resistant material thereby resulting in the sharp edge.

10. The processing method of claim 9 wherein the step of preparing the first surface includes exposing the first surface to a microetch including sulfuric and ferric chloride acids.

11. The processing method of claim 9 wherein the step of preparing the first surface includes exposing the first surface to an acid wash.

12. The processing method of claim 9 wherein the etching step further comprises the step of etching using ferric chloride acid.

13. The processing method of claim 9 wherein the first etch resistant material is photo-resist.

14. The processing method of claim 13 wherein the step of forming a first pattern in the first etch resistant material includes exposing the first etch resistant material to ultraviolet light.

15. The processing method of claim 9 further comprising a step of covering the first etch resistant material on the first surface with a protective coating before the step of cleaning the second surface.

16. The processing method of claim 9 wherein the first and second pattern include a plurality of openings, and wherein the etching step forms holes through the metal foil.

17. The processing method of claim 1 wherein the step of preparing the first surface includes contaminating the first surface.

18. The processing method of claim 1 wherein the first etch resistant material includes an adhesion inhibiting material.

19. A thin material processing method comprising the steps of:

preparing a first surface of a thin base material;

adhesively bonding a first etch resistant material to the first surface to form a first adhesive bond between the first etch resistant material and the first surface;

forming a first pattern in the first etch resistant material on the first surface, the first pattern defining at least one boundary of the first etch resistant material;

cleaning a second surface of the thin base material, the second surface being on a side opposite the first surface;

adhesively bonding a second etch resistant material to the second surface to form a second adhesive bond between the second etch resistant material and second surface, the second adhesive bond being substantially stronger than the first adhesive bond;

forming a second pattern in the second etch resistant material on the second surface, the second pattern defining at least one boundary of the second etch resistant material on the second surface;

etching the thin base material to form:

a rounded edge in the thin base material at the at least one boundary of the first pattern of first etch resistant material by degrading the first adhesive bond of the thin base material and the first etch resistant material at the at least one boundary of the first pattern of first etch resistant material, and a sharp edge at the at least one boundary of the second pattern of second etch resistant material by preventing etching of the thin base material beyond the at least one boundary of the second pattern of second etch resistant material by maintaining the second adhesive bond.

* * * * *